US010562169B2

(12) United States Patent
Duernegger

(10) Patent No.: US 10,562,169 B2
(45) Date of Patent: Feb. 18, 2020

(54) HAND-GUIDED MACHINE TOOL WITH ERGONOMIC GRIP PART

(71) Applicant: C. & E. Fein GmbH, Schwaebisch Gmuend-Bargau (DE)

(72) Inventor: Wolfgang Duernegger, Schorndorf (DE)

(73) Assignee: C. & E. Fein GmbH, Schwaebisch Gmuend-Bargau (DE)

( * ) Notice: Subject to any disclaimer, the term of this patent is extended or adjusted under 35 U.S.C. 154(b) by 507 days.

(21) Appl. No.: 15/333,805

(22) Filed: Oct. 25, 2016

(65) Prior Publication Data

US 2017/0036338 A1 Feb. 9, 2017

Related U.S. Application Data

(63) Continuation of application No. PCT/EP2015/058502, filed on Apr. 20, 2015.

(30) Foreign Application Priority Data

Apr. 25, 2014 (DE) ..... 10 2014 105 842

(51) Int. Cl.
*B24B 23/02* (2006.01)
*B25F 5/02* (2006.01)

(52) U.S. Cl.
CPC ..... *B25F 5/02* (2013.01); *B24B 23/028* (2013.01)

(58) Field of Classification Search
CPC ..... B24B 23/028; B24B 23/02; B24B 23/00; B25F 5/02; B25F 5/00; B25F 5/026; Y10T 16/476
USPC ..... 451/489, 491, 358, 359, 360; 16/430; 408/124, 241 R
See application file for complete search history.

(56) References Cited

U.S. PATENT DOCUMENTS 1,951,964 A * 3/1934 Burleigh ..... B24B 23/028 451/359
2,123,222 A 7/1938 Albertson
4,136,579 A * 1/1979 Robinson ..... B25H 1/0057 173/36
4,881,294 A * 11/1989 Riedl ..... B25F 5/003 16/426
4,936,394 A 6/1990 Ohtsu
5,052,500 A 10/1991 Ohtsu
5,201,146 A * 4/1993 Fushiya ..... B23D 45/16 451/358
5,339,572 A * 8/1994 Eicher ..... B23D 45/16 451/358

(Continued)

FOREIGN PATENT DOCUMENTS

DE 3913971 A1 11/1989
DE 9319263 U1 4/1994

(Continued)

*Primary Examiner* — Andrew M Tecco
*Assistant Examiner* — Nicholas E Igbokwe
(74) *Attorney, Agent, or Firm* — Muncy, Geissler, Olds & Lowe, P.C.

(57) ABSTRACT

A hand-guided machine tool is provided, in particular a hand-guided electric power tool, having a housing, whereon a grip part is provided which projects from a stop surface at one end of the housing, wherein the stop surface protrudes laterally with respect to the grip part at all sides and merges into the grip part via a preferably concave curvature.

19 Claims, 3 Drawing Sheets

(56) References Cited

U.S. PATENT DOCUMENTS 5,407,381 A * 4/1995 Schaefer ..... B24B 23/028 451/344
5,558,570 A * 9/1996 Nakamura ..... B24B 23/00 16/426
6,108,867 A * 8/2000 Nagashima ..... F02D 11/02 16/110.1
6,155,916 A * 12/2000 Rudolf ..... B25F 5/026 451/344
6,293,859 B1 9/2001 Fink et al.
2003/0002937 A1 1/2003 Miura
2003/0200841 A1* 10/2003 Novotny ..... B25F 5/02 81/177.8
2005/0205277 A1* 9/2005 Wu ..... B25F 5/02 173/217
2005/0247466 A1* 11/2005 Andriolo ..... B25F 5/02 173/170
2006/0025060 A1* 2/2006 Funk ..... B25F 5/02 451/358
2009/0133889 A1* 5/2009 Keller ..... B23B 45/001 173/104
2013/0055860 A1 3/2013 French

FOREIGN PATENT DOCUMENTS

DE 19745306 A1 4/1999
DE 19900404 A1 7/2000
DE 10023226 C1 10/2001
DE 10055395 A1 5/2002
DE 102004051653 A1 4/2006
EP 1016505 A2 7/2000
EP 2221150 A1 8/2010
JP H10166283 A 6/1998
WO 2006045657 A1 5/2006
WO 2014005800 A1 1/2014

* cited by examiner

HAND-GUIDED MACHINE TOOL WITH ERGONOMIC GRIP PART

CROSS REFERENCES TO RELATED APPLICATIONS

This application is a continuation of international patent application PCT/EP2015/058502, filed on Apr. 20, 2015 designating the U.S.A., which international patent application has been published in German language and claims priority from German patent application 10 2014 105 842.9, filed on Apr. 25, 2014. The entire contents of these applications is incorporated herein by reference.

BACKGROUND OF THE INVENTION

The invention relates to a hand-guided machine tool, in particular to a hand-guided electric power tool, comprising a housing, whereon a grip part is provided that protrudes from one end of the housing.

Such a hand-guided machine tool being configured as a so-called "two-handed angle grinder" is known from DE 199 00 404 A1. Herein at an end of the housing facing away from the grinding tool a grip part is provided which can be encompassed with one hand and whereon a push button is provided that is equipped with a lock button. The grip part extends substantially continuously with the upper end of the housing contour and retracts somewhat with respect to the lower housing contour at the side of the lock button. In use the angle grinder is held with one hand at the grip part, wherein simultaneously the lock button must be impressed, while the angle grinder is held with the other hand at a shaft handle which protrudes laterally from the gear housing. If the user releases the rear grip handle then immediately a braking function is initiated due to safety reasons.

An angle grinder of similar design is known from DE 100 23 226 C1.

The known hand-guided machine tools have the disadvantage that reaction forces of the machine tool are not introduced homogeneously into the hand of the user or that the hand palm cannot be coupled to the grip surface sufficiently due to geometry reasons. An introduction of the feed forces necessary for the processing is performed force-fitted with the known grip parts, which may lead to a strong physical tiring. In many cases the known designs of grip parts do not match the anatomic or physiological demands with respect to a low-fatigue gripping situation. Such a design of the grip part which is not sufficiently ergonomic in particular affects heavy, hand-guided machine tools disadvantageously, such as heavy two-handed angle grinders and leads to fast fatigue occurrences. Thereby motivation and attention are impaired during the operation of the hand-guided machine tool, and simultaneously the accident risk increases.

SUMMARY OF THE INVENTION

In view of this it is a first object of the invention to disclose an improved hand-guided machine tool wherein the grip part allows a force introduction into the machine tool in an ergonomic way.

It is a second object of the invention to disclose an improved hand-guided machine tool wherein fatigue occurrences are reduced and an improved force transmission between the machine tool and the hand of a user is made possible.

It is a third object of the invention to disclose an improved hand-guided machine tool wherein the grip part allows for a more precise guidance of the machine tool when gripping around the grip part.

These and other objects are achieved according to one aspect of the invention by a hand-guided machine tool, in particular a hand-guided electric power tool, comprising a housing whereon a grip part is provided extending from a stop surface at one end of the housing, wherein the stop surface projects with respect to the grip part laterally at all sides and that transitions into a curvature of the grip part which is preferably concave.

The object of the invention is solved in this way.

According to the invention the stop surface projecting laterally at all sides with respect to the grip part that transitions into the grip part, a direct stop of the hand of the user against the stop surface results when encompassing the grip part. By the protrusion at all sides beyond the grip part a rest of the hand at the stop surface is made possible at all sides. Thereby a considerably improved force introduction from the hand onto the machine tool results, and a direct feedback of reaction forces of the machine tool onto the hand of the user, respectively.

According to a further development of the invention the stop surface projects at all sides with respect to the grip part by an amount of at least 3 mm, preferably of at least 5 mm.

According to a further development of the invention the stop surface comprises two lateral sections arranged opposite to each other, with a front section lying therebetween and with a rear section lying therebetween, wherein the stop surface in the region of the rear section projects with respect to the grip part by an amount of at least 10 mm, preferably of at least 15 mm, particularly preferred of at least 18 mm.

According to a further feature of the invention the stop surface comprises two lateral sections facing each other, with a front section lying therebetween, and with a rear section lying therebetween, wherein at least the lateral sections merge into the grip part with a curvature radius of 5 mm to 10 mm.

By these features a particularly ergonomic resting of the human hand against the stop surface is assisted, whereby a fatigue-free working is facilitated and at the same time a good force transmission between the machine tool and the hand of the user is made possible. Herein in particular also the situations are accommodated which are provided by the wearing of protective gloves.

According to a further development of the invention the stop surface at least at the front section is bent in the direction perpendicularly to the housing longitudinal axis substantially V-shaped into the direction of the housing.

Depending on whether the grip part is encompassed with the right or the left hand, either the right or the left pointer finger rests against a leg of the V-shaped curvature. Thereby the position of the pointer finger is stabilized and thus a secure gripping is facilitated.

According to a further development of the invention the stop surface at least at the rear section in the direction perpendicularly to the housing longitudinal axis is bent towards the housing substantially V-shaped.

Thereby an improved adaptation with respect to the resting of the human hand against the stop surface is ensured, since the stop surface with the V-shaped course can rest within the depression between the thumb and the pointer finger.

According to a further development of the invention the lateral sections of the stop surface are formed identically and can serve as a stop for a cylindric test body of 10 mm to 15 mm, preferably of 14 mm diameter, wherein by the resting of the cylindrical test body against the lateral sections a stop plane is defined which is tilted with respect to a housing longitudinal axis at an angle of 50° to 90°, preferably of 60° to 80°, further preferred of 64° to 70°, particularly preferred of 66° to 68°.

By such a tilting of the stop plane with respect to the housing longitudinal axis of the machine tool a particularly fatigue-free position during the resting of the hand of the user against a stop surface and at the simultaneously holding of the machine tool at a lateral shaft handle is made possible.

According to a further design of the invention the grip part comprises a first section facing the stop surface having a first end facing the stop surface, and having a second section facing away from the stop surface including an end facing away from the stop surface, wherein the grip part comprises a middle section between the two ends having a larger thickness than at the two ends.

Thereby a simplified encompassing of the grip part with one hand is made possible, wherein simultaneously a fatigue-free resting of the hand against the stop surface is facilitated. The force transmission between the grip part and the housing of the machine tool is improved in this way.

According to a further feature of the invention by the course of the centers of area determined in a middle plane between two lateral sections of the grip part facing each other, a first grip main axis is defined facing away from the stop surface and being substantially straight which is tilted with respect to the stop plane at an angle of 55° to 90°, preferably of 65° to 85°, further preferred of 69° to 81°, particularly preferred of 73° to 75°.

By such a tilting of the first grip main axis with respect to the stop surface a particularly advantageous force transmission between the grip part and the stop surface, or the housing of the machine tool, respectively, is made possible.

According to a further development of the invention the grip part in the region of its two ends defines a minimum thickness determined in a middle plane respectively between two lateral sections facing each other, wherein a straight line running through the two center points of the two minimum thicknesses defines a first grip main axis which is tilted with respect to the stop plane at an angle of 55° to 90°, preferably of 65° to 85°, further preferred of 69° to 81°, particularly preferred of 73° to 75°. A position of the first grip main axis defined in this way within the frame of the measurement precision coincides with the position of the first grip main axis defined by the position of the centers of area, as mentioned above.

The angular position of the first grip main axis defined in this way with respect to the stop plane leads to the above-mentioned particularly ergonomic arrangement of the grip part with respect to the stop plane, whereby a particularly good force transmission between the grip part and the housing of the machine tool is made possible.

It will be understood that instead of the relation between the angle of the first and second, respectively, grip main axis with respect to the stop plane also the angular relation between the first and second, respectively, grip main axis and the longitudinal axis of the housing can be used for the angular definition. The longitudinal axis of the housing is defined by the motor and the motor shaft that rotates around its longitudinal axis. The longitudinal axis of the motor shaft thus coincides with the longitudinal axis of the housing.

If the angle $\varphi_1$ between the stop plane and the housing longitudinal axis is for instance 67°, and the angle $\varphi_2$ between the stop plane and the first grip main axis is 74°, then $\varphi_2=+\varphi_4=\varphi_1+7°$. This means that the grip part is tilted with respect to the housing longitudinal axis by an angle $\varphi_4=7°$. In a corresponding way also the angular position of the second grip main axis with respect to the housing longitudinal axis can be defined. If for instance the angle $\varphi_1$ between the stop plane and the housing longitudinal axis is 67° and the angle $\varphi_3$ between the second grip main axis and the stop plane is 79° then an angle $\varphi_5=\varphi_3-\varphi_1=79°-67°=12°$ between the second grip main axis and the housing longitudinal axis results.

According to a further development of the invention the grip part in a direction perpendicular to the middle plane of the grip part is embossed convexly on both sides, wherein the grip thickness at the first end facing the stop surface is smaller than at the second end.

Thereby the holding of the machine tool at the grip part is facilitated and fatigue phenomenons after longer work are counter-acted.

Preferably in the region of the grip part a push button is received pivotably which preferably cooperates with a lock button. By the lock button a locking may be facilitated in the impressed state. Alternatively or in addition the lock button may serve as a switch lock.

In this way an arresting of the push button in the working position is made possible, to thus allow a more fatigue-free working.

According to a further development of the invention an enlarged stop surface for resting of the ring finger follows onto the push button into the direction of the second end of the grip part.

In this way a natural gripping position is facilitated and a safe gripping of the grip part is facilitated.

According to a further development of the invention the grip part between its first end and its second end comprises a substantially oval perimeter having a long axis extending in the direction of its longest extension, wherein the long axis at the transition from the first to the second end is at least once rotated by 90°.

Also in this way an ergonomic gripping of the grip part when encompassing with one hand is facilitated. In particular an induction of axial forces from the hand onto the grip part or of reaction forces, respectively, from the housing via the grip part onto the hand of the user is improved.

According to a further development of the invention the grip part at its second end facing away from the stop surface comprises an end stop at one side, whereby the outer perimeter is increased at one side.

In this way a skidding-down of the hand from the grip part when handling the machine tool is counter-acted.

It will be understood that the afore-mentioned features and the features of the invention to be explained hereinafter cannot only be used in the given combination, but also in different combinations or independently, without leaving the scope of the invention.

BRIEF DESCRIPTION OF THE DRAWINGS

Further features and advantages of the invention can be taken from the subsequent description of preferred embodiments with reference to the drawings. In the drawings show.

DESCRIPTION OF PREFERRED EMBODIMENTS

Figure 1:
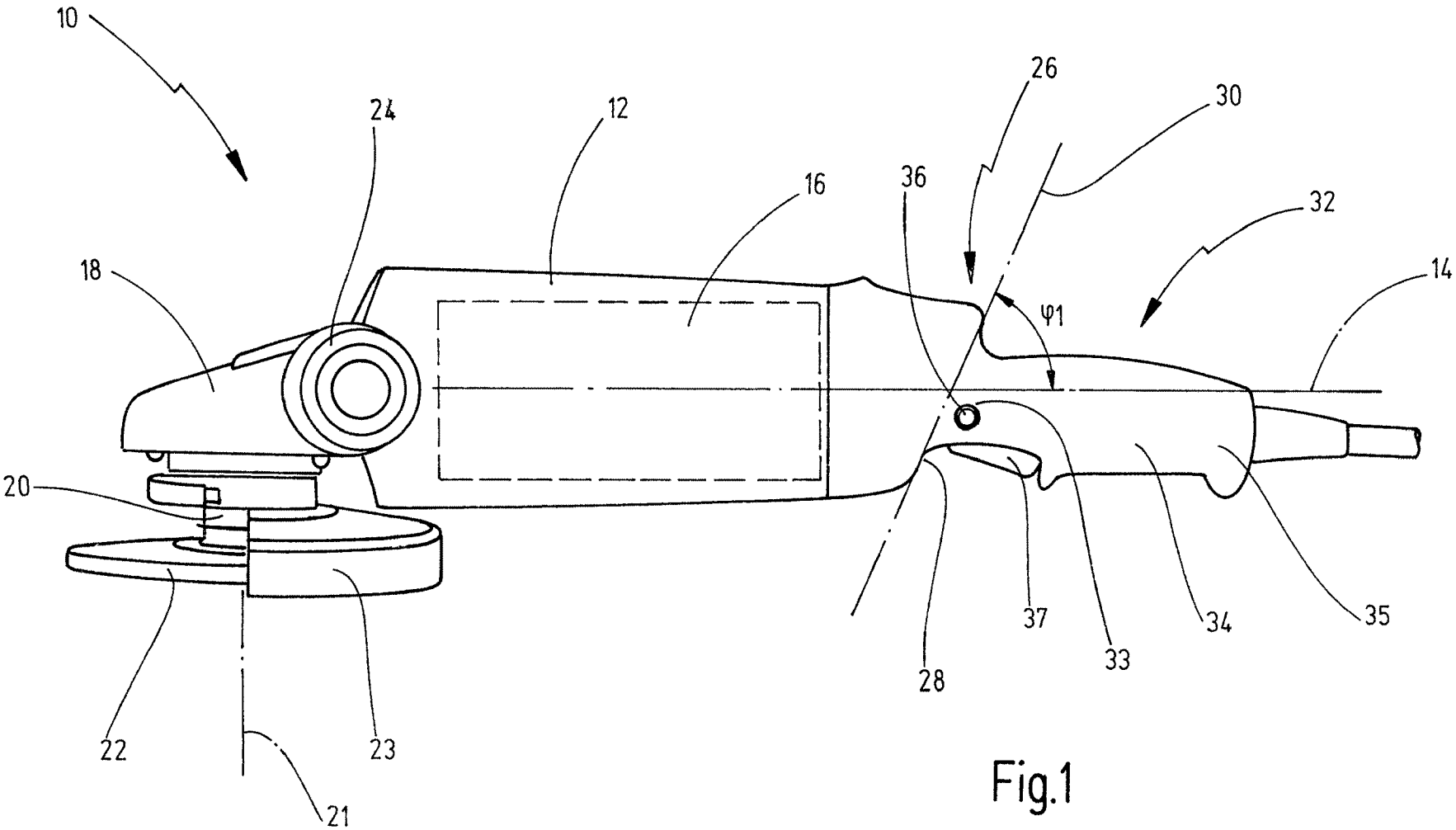
FIG. 1 a side elevation of a first embodiment of a machine tool according to the invention being configured as a two-handed angle grinder.

In FIG. 1 a hand-guided machine tool according to the invention is shown in a side view, being configured as an exemplary design of a two-handed angle grinder.

The machine tool 10 comprises a housing 12 whereon at one end a gear housing 18 is received from which a tool spindle 20 for receiving a tool 22 being configured as a grinding disk protrudes. The grinding disk is partially covered by a protecting hood 23. Laterally at the gear housing 18 a shaft handle 24 is secured which serves for holding the machine tool 10 with the left hand in this region. At the end 26 of the housing 12 facing away from the gear housing 18 there is received a grip part 32 at which the machine tool 10 can be encompassed with the right hand and held therewith. If the machine tool 10 shall be used by a left-handed person, then the shaft handle 24 is screwed off from the receptacle at the left side of the gear housing 18 and is screwed onto the opposite side into a respective support at the right side of the gear housing 18. The machine tool 10 can then be held with the right hand at the shaft handle 24 on the right side of the gear housing 18, and with the left hand at the grip part 32.

Since in the present case an angle grinder is presented, the spindle axis 21 of the tool spindle 20 extends perpendicularly to the housing longitudinal axis 14 which is defined by the motor 16, or the motor shaft thereof, respectively, received within the housing 12. However, it is understood that the spindle axis 21 of the tool spindle 20 may also extend at a different angle with respect to the housing longitudinal axis 14, for instance may be parallel to the housing longitudinal axis 14 or may be aligned therewith, such as with a straight grinder.

According to the invention the grip part 32 is connected with the second end 26 of the housing 12 via a stop surface 28. Herein the design is made so that the grip part 32 protruding laterally from the end 26 of the housing 12 merges into the end 26 of the housing 12 by means of the stop surface 28 which projects on all sides with respect to the grip part 32. The stop surface 28 herein is bent on all sides concavely. The stop surface 28 defines a stop plane 30 extending at an angle (p with respect to the housing longitudinal axis 14. The definition of the position of the stop plane 30 with respect to the housing longitudinal axis 14 will subsequently be explained in more detail with reference to FIG. 2.

The grip part 32 comprises a first front end 33 on the side of the stop surface 28 and a second, rear end 35 facing away from the stop surface 28. Between the two ends 33, 35 there is a middle region 34. In the region of the front end 33 of the grip part 32 at the left side a lock button 36 is received which may be impressed with the thumb. Below the lock button 36 there is received a push button 37 pivotably which is mechanically coupled with the lock button 36 so that the push button 37 may be locked in a pivoted position, such as shown in FIG. 1.

The geometric design and the configuration of the grip part 32 with respect to the housing 12 subsequently are described in more detail with reference to FIGS. 2 through 5.

The angle $\varphi_1$ between the housing longitudinal axis 14 and the stop plane 30, which in the present case is about 67°, is determined by the resting of the hand of a user against the stop surface 28. To allow for a precise definition of the position of the stop plane 30 with respect to the housing longitudinal axis 14, even in view of the physiological differences of the human hand, and even in view of the spatially varying surface of the stop surface 28, there is placed a test body of 14 mm diameter against the two side surfaces 41 opposite each other according to FIG. 2 or 40, 41 according to FIG. 3 that have a constant curvature course with a concave curvature for a certain region. By the resting of the test body against the side surfaces 40, 41 an exact angular position of the stop plane 30 results. Herein the diameter of the test body of 14 mm is approximated by a contact-effective diameter of an average human thumb and pointer finger.

Figure 2:
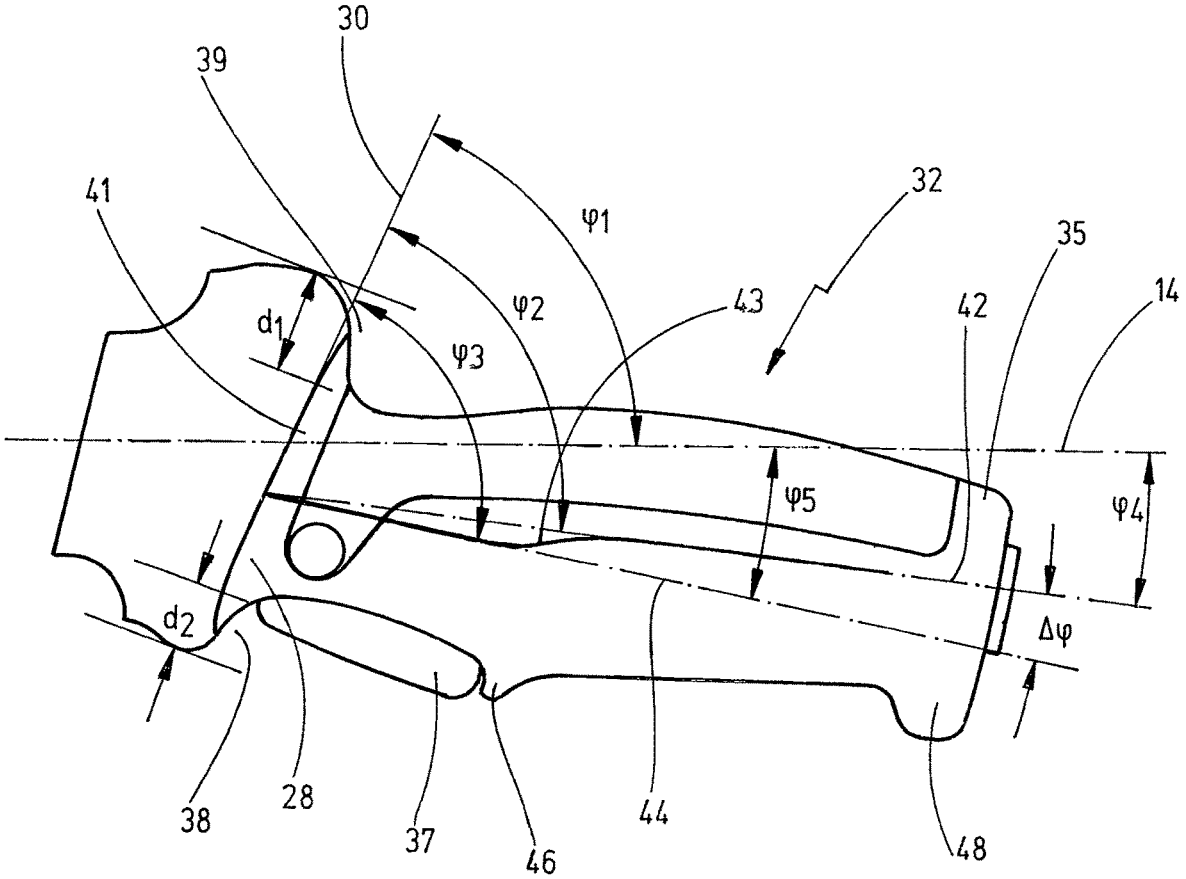
FIG. 2 an enlarged representation of the grip part according to FIG. 1 including an extension surface received thereon with which the grip part engages into the assigned housing of the machine tool.

The grip part 32 comprises two grip main axes 42, 44, namely a first grip main axis 42, and a second grip main axis 44 which is continuously connected with the first grip main axis 42 via a continuous transition region. When the centers of area of the grip part 32 within the drawing plane shown in FIG. 2 are determined, i.e. within a plane parallel to a middle plane ME between the two lateral sections 40, 41 opposite to each other, then these extend along the first grip main axis 42 along a continuous transition region 43 and along a second grip main axis 44. Both grip main axes 42, 44 extend straight (within an error tolerance of about ±0.5 mm). The first grip main axis 42 extends at an angle $\varphi_4$ of 7° with respect to the housing longitudinal axis 14. In a correspondent way thus the angle $\varphi_2$ between the first grip main axis 42 and the stop plane 30 is 74°. The angle $\Delta\varphi$ between the first grip main axis 42 and the second grip main axis 44 is 5°. Thus an angle $\varphi_5$ of 12° between the housing longitudinal axis 14 and the second grip main axis 44 results. The angle $\varphi_3$ between the stop plane 30 and the second grip main axis 44 is thus 79°.

As already mentioned above the stop surface 28 projects at all sides laterally with respect to the grip part 32. The grip part 32 is thus enclosed substantially ring-shaped by the stop surface 28. From FIG. 2 it can be seen that at a rear section 39 facing away from the push button 37 the protrusion $d_1$ of the stop surface 28 between the grip part 32 and the stop surface 28 is about 21 mm. On the opposite side the protrusion $d_2$ between the stop surface 28 and the grip part 32 is about 6 mm with impressed push button 37. At the two side surfaces according to FIG. 3 there is a protrusion $d_3$ of about 16 mm between the grip part 32 and the stop surface 28 at the two side sections 40, 41.

According to FIG. 2 the grip part 32 at its lower side adjacent to the push button 37 comprises an enlarged stop surface 46 which serves for resting the ring finger from the outer side when encompassing the grip part 32 and for resting against the stop surface 28. At the second end 35 of the grip part 32 at the lower side there is an end stop 48, whereby the outer perimeter of the grip part 32 is enlarged along a certain angular region of about 90°.

Figure 3:
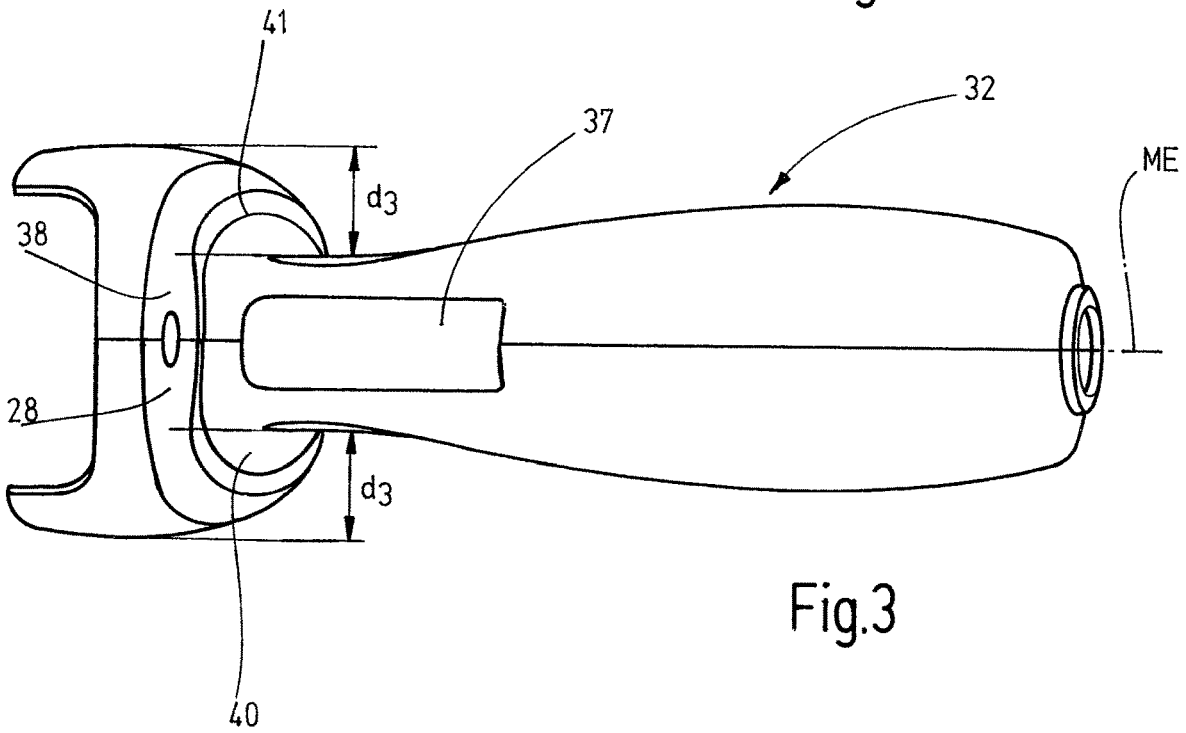
FIG. 3 a view of the grip part according to FIG. 2, seen from the side of the push button.
Figure 4:
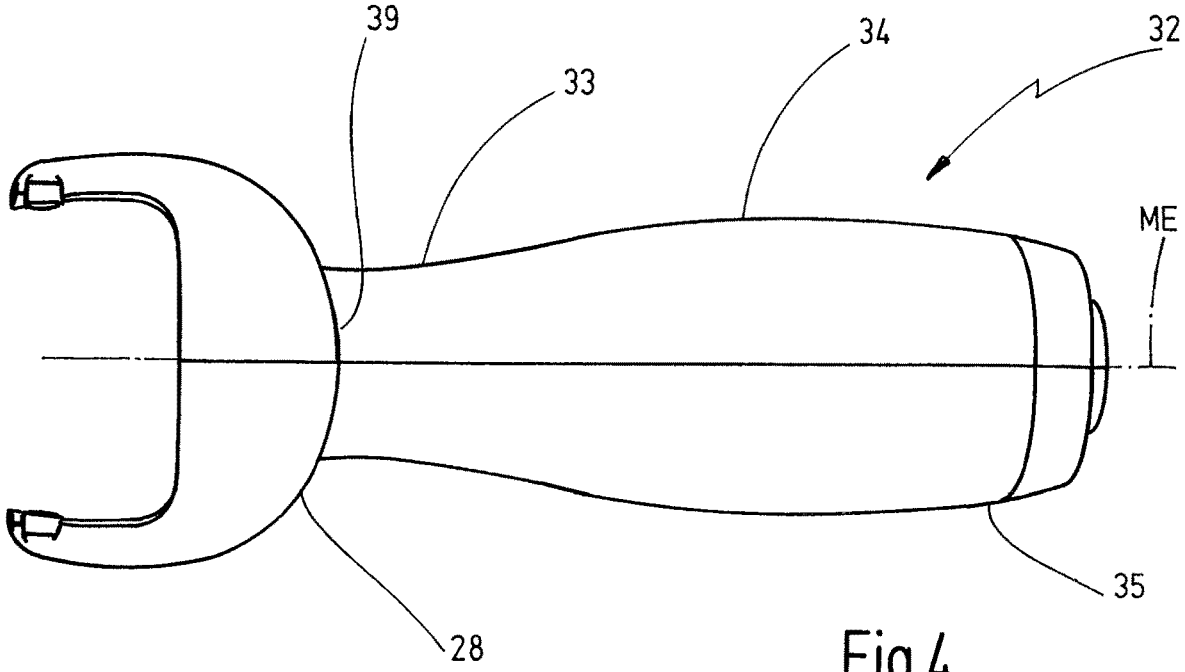
FIG. 4 a view of the grip part according to FIG. 2, seen from a side facing away from the push button.

As can be seen in particular from the representations according to FIGS. 2, 3, 4 the grip part 32 is configured embossed or bomb-shaped, i.e. it has in its middle region 34 a larger perimeter than in the region of its two ends 33, 35. In addition the cross-section of the grip part 32 along its longitudinal extension can be defined substantially by an oval having a long axis indicating the largest extension of the oval.

Starting from the first end 33 of the grip part 32 the angular position of the long axis of the oval varies via the middle range 34 until the second end 35. While the long axis of the oval at the first end 33 coincides with the middle plane ME, the long axis of the oval in the middle range 34 is rotated by 90° and thus extends perpendicularly to the middle plane ME. Depending on the design of the grip shape there may be a range of constant thickness. A constant thickness range in this regard is understood as a cross-section having the same diameters in two directions perpendicular to each other (i.e. the same thickness). Towards the range of the second end 35 there may be a further rotation of the long axis of the oval by 90°, or in the range of the second end 35 there may be a constant thickness.

By these different variations the natural grip shape of the human hand is assisted, whereby the gripping comfort is improved and the fatigue of the hand for keeping the working situation is improved to a great extent. By increasing the encompassing measure into the direction to the second end 35 an increase of the support effect of the outer heel of hand results, whereby the coupling surface between the hand and the grip is improved.

As can be seen from FIG. 3, the stop surface 28 at the front section 38 in the direction perpendicularly to the middle plane ME is substantially bent V-shaped into the direction of the housing 12.

Thereby a resting of the human hand against the stop surface 28 is facilitated, since the stop surface 28 rests with the V-shaped region into the depression between the thumb and the pointer finger.

An alternative possibility for defining the first grip main axis 42 in the following is explained in more detail with reference to FIG. 5.

In the region of the first end there is a range of a minimum thickness designated with $t_1$, wherein this is measured with impressed push button 37. In the range of the second end 35 of the grip part 32 again there is defined a minimum thickness $t_2$. When the center points of the lines $t_1$ and $t_2$ are plotted then the center points $M_1$ and $M_2$ result. A straight line connecting the two center points $M_1$, $M_2$ defines the first grip main axis 42. This within the tolerance range of ±0.5° is in confirmation with the grip main axis 42 defined according to FIG. 2. Thus also the angle $\varphi_2$ between the stop plane 30 and the first grip main axis 42 results which is preferably 74°.

In addition the grip part 32 may have regions with varying surface texture, whereby the handling characteristics are assisted.

Thus for instance the surface facing away from the push button 37 may be equipped with a rubber lining or with nop-like elevations for further improving the haptics.

Figure 5:
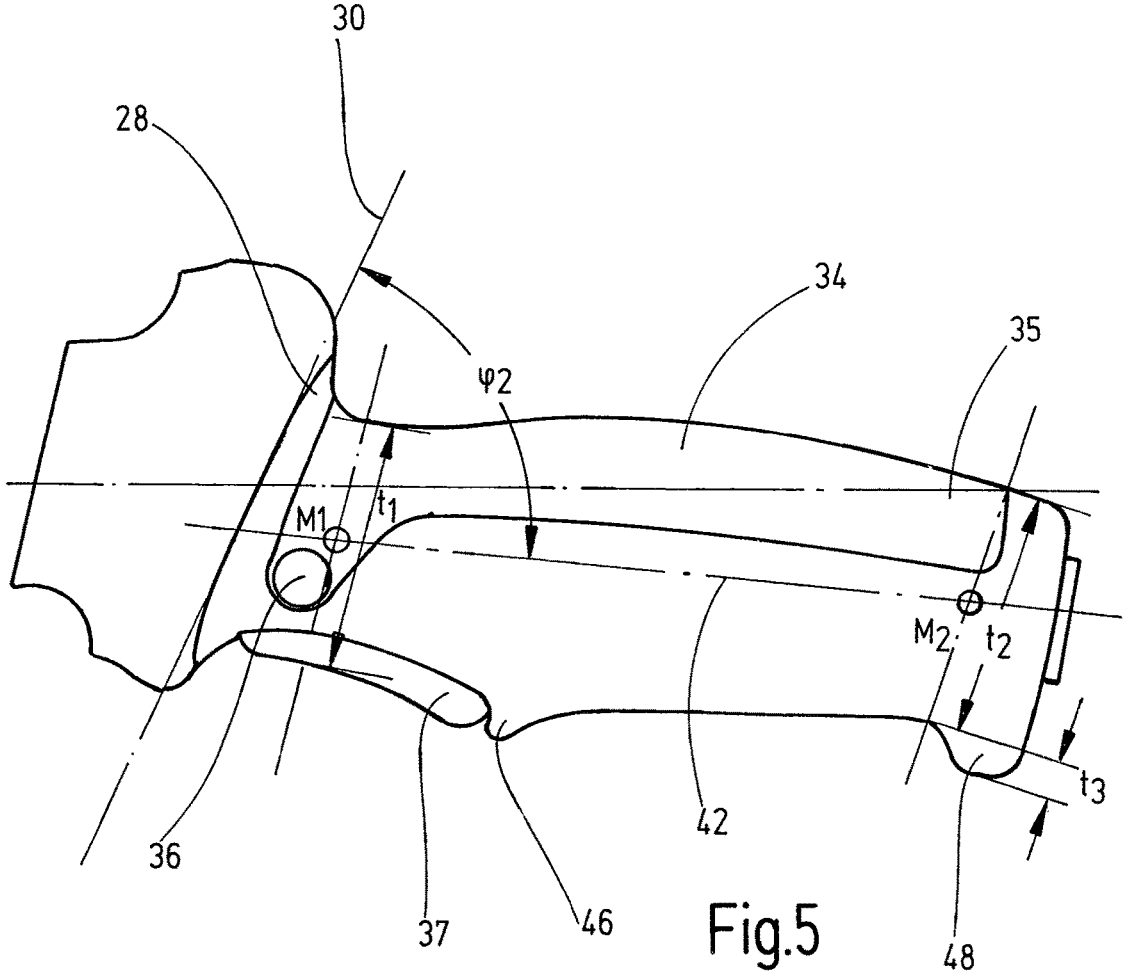
FIG. 5 a side view of the grip part according to FIG. 2, however with a different dimensioning, whereby the angular relation between the grip part and the stop plane or the housing longitudinal axis, respectively, are determined.

The end stop 48 according to FIG. 5 preferably has a thickness $t_3$ in the direction of the minimum thickness $t_2$ which is in the range of 7 to 9:42, that is between 0.17 und 0.214. The safety to prevent that the machine tool during transport slips out of the hand is particularly improved in this way.

What is claimed is:

1. A hand-guided machine tool, comprising:

a housing having a housing longitudinal axis and a stop surface at one end of said housing;

a grip part protruding from said stop surface, such that said stop surface projects from an upper surface, a lower surface and both side surfaces of said grip part and merges into each of said upper surface, said lower surface and said both side surfaces of said grip part via a concave curvature, such that said grip part and said stop surface are a single, monolithic structure;

wherein said stop surface comprises two lateral sections opposite to each other, with a front section lying therebetween and a rear section lying therebetween, wherein at least said two lateral sections merge into said grip part with a radius of curvature of 5 to 10 mm;

wherein said two lateral sections serve as a stop that forms a stop plane that is tilted with respect to said housing longitudinal axis by an angle of 50° to 80°.

2. The machine tool of claim 1, wherein said stop plane is tilted with respect to said housing longitudinal axis by an angle of 64° to 70°.

3. The machine tool of claim 1, wherein said stop surface projects from said upper surface, said lower surface and said both side surfaces of said grip part by an amount of at least 3 mm.

4. The machine tool of claim 1, wherein said rear section of said stop surface projects with respect to said grip part by an amount of at least 10 mm.

5. The machine tool of claim 1, wherein at least said front rear section of said stop surface is bent substantially V-shaped towards said housing in a direction perpendicular to said housing longitudinal axis.

6. The machine tool of claim 1, wherein said grip part comprises a first region facing towards said stop surface having a first end facing said stop surface, and further comprises a second region facing away from said stop surface and having a second end facing away from said stop surface, wherein said grip part in a middle region between said first end and said second end has a larger thickness than at said first end and said second end.

7. The machine tool of claim 1, wherein said grip part in a plane extending through a middle plane determined between two lateral sections of said grip part opposite each other comprises centers of area extending on a course defining a first grip main axis facing away from said stop surface, which is tilted with respect to said stop plane at an angle which is between 55° and 85°.

8. The machine tool of claim 7, wherein said grip part in addition comprises a second grip main axis which merges continuously via a transition region into said first grip main axis, wherein said second grip main axis is tilted with respect to said first grip main axis by an angle of 2° to 10°.

9. A hand-guided machine tool, comprising:

a housing having a housing longitudinal axis and a stop surface at one end of said housing;

a grip part protruding from said stop surface, such that said stop surface projects from an upper surface, a lower surface and both side surfaces of said grip part and merges into each of said upper surface, said lower surface and said both side surfaces of said grip part via a concave curvature, such that said grip part and said stop surface are a single, monolithic structure;

wherein said grip part has a first grip main axis that is tilted with respect to said housing longitudinal axis at an angle of 5° to 20°.

10. The machine tool of claim 9, wherein said grip part defines two center points of a minimum thickness determined within a middle plane between two lateral sections of said stop surface arranged opposite each other, wherein said first grip main axis is defined by a straight line extending through said two center points, and wherein said first grip main axis is tilted with respect to a stop plane of said stop surface at an angle which is 55° to 85°.

11. The machine tool of claim 10, wherein said grip part in addition comprises a second grip main axis which merges continuously via a transition region into said first grip main axis, wherein said second grip main axis is tilted with respect to said first grip main axis by an angle of 2° to 10°.

12. The machine tool of claim 10, wherein said two lateral sections serve as a stop that forms said stop plane, said stop plane being tilted with respect to said housing longitudinal axis by an angle of 50° to 80°.

13. The machine tool of claim 9, wherein a rear section of said stop surface is bent substantially V-shaped towards said housing in a direction perpendicular to said housing longitudinal axis.

14. The machine tool of claim 9, wherein said stop surface comprises two lateral sections opposite to each other, with a front section lying therebetween and a rear section lying therebetween, wherein at least said two lateral sections merge into said grip part with a radius of curvature of 5 to 10 mm.

15. A hand-guided machine tool, comprising:

a housing having a housing longitudinal axis and a stop surface at one end of said housing;

a grip part protruding from said stop surface, such that said stop surface projects from an upper surface, a lower surface and both side surfaces of said grip part and merges into each of said upper surface, said lower surface and said both side surfaces of said grip part via a concave curvature, such that said grip part and said stop surface are a single, monolithic structure;

wherein said grip part comprises a first end facing said stop surface and a second end facing away from said stop surface, said grip part being shaped convexly embossed on both said first end and said second end, said grip part having a first thickness at said first end facing said stop surface that is smaller than a second thickness of said grip part at said second end.

16. The machine tool of claim 15, wherein said grip part between said first end and said second end comprises an oval perimeter.

17. The machine tool of claim 15, wherein said grip part further comprises a push button arranged pivotably thereon and a lock button cooperating with said push button.

18. The machine tool of claim 17, wherein said push button into a direction of a second end of said grip part is followed by an enlarged stop surface.

19. The machine tool of claim 18, wherein said grip part at said second end facing away from said stop surface comprises an end stop at one side, whereby an outer perimeter at said one side is enlarged.

* * * * *